US005229740A

United States Patent [19]

Mizutani et al.

[11] Patent Number: 5,229,740

[45] Date of Patent: Jul. 20, 1993

[54] THERMALLY RESPONSIVE SWITCH

[75] Inventors: Yasukazu Mizutani, Nagoya; Shigemi Satoh, Tokai; Hideki Koseki, Aichi, all of Japan

[73] Assignee: Ubukata Industries Co., Ltd., Nagoya, Japan

[21] Appl. No.: 958,086

[22] Filed: Oct. 8, 1992

[30] Foreign Application Priority Data

Oct. 9, 1991 [JP] Japan ..... 3-290833

[51] Int. Cl.[5] ..... H01H 37/54; H01H 37/04

[52] U.S. Cl. ..... 337/354; 337/89; 337/365

[58] Field of Search ..... 337/365, 89, 53, 354, 337/372, 380

[56] References Cited

U.S. PATENT DOCUMENTS 5,121,095 6/1992 Ubukata et al. ..... 337/365

*Primary Examiner*—Harold Broome

*Attorney, Agent, or Firm*—Foley & Lardner

[57] ABSTRACT

A thermal protector includes a metal housing having open and closed ends, a header plate secured to the housing so as to close its open end and having two through-apertures, first and second terminal pins hermetically secured in the respective apertures of the header plate so as to extend into the housing, a dish-shaped bimetal disposed on an inner bottom of the housing so that one of its two sides is in contact with the inner bottom face of the housing, an elastic support disposed in the housing to be opposite to the other side of the bimetal for supporting it, a pair of fixed and movable contact members welded to the first and second terminal pins respectively such that a straight line passing through the center of the first terminal pin and a location of the fixed contact member welded to the first terminal pin is approximately parallel to a straight line passing through the center of the second terminal pin and a location of the movable contact member welded to the second terminal pin and vice versa and further such that the location of the fixed contact member welded to the first terminal pin is not substantially opposed to the location of the movable contact member welded to the second terminal pin and vice versa, and a pressure strip disposed between the support and the movable contact member for transmitting movement of the support due to reversion of the bimetal to the movable contact member.

4 Claims, 3 Drawing Sheets

THERMALLY RESPONSIVE SWITCH

BACKGROUND OF THE INVENTION

1. Field of the Invention

This invention relates to a thermally responsive switch comprising a thermally responsive element and a switching element enclosed in a hermetically sealed housing, and more particularly to such a thermally responsive switch sensing the temperature of a heated portion of a compressor circulating a refrigerant to a heat exchange system, engine transmission of an automobile or the like, for protecting these equipments against the damage due to the heating.

2. Description of the Prior Art

The present invention provides an improvement of the invention assigned U.S. Pat. No. 5,121,095. Referring to FIG. 6, this patented invention provides a thermally responsive switch comprising a housing 101 with an opening. A header plate 102 is secured to the housing 101 to close its opening and has two apertures formed therethrough. First and second electrically conductive terminal pins 103A and 103B extend through the apertures of the header plate 102 and secured in them by a filler such as glass, respectively. A fixed contact member 104A and a movable contact member 104B both serving as a switching element 108 are welded to ends of the terminal pins 103A, 103B extending in the housing 101 respectively. A thermally responsive element 105 is disposed on an inner bottom face of the housing 101. The thermally responsive element 105 is formed from a bimetal and has the shape of a generally shallow dish. A support 106 formed of a leaf spring is disposed between the thermally responsive element 105 and a pressure strip 107 coupled to the movable contact member 104B. The thermally responsive element 105 reverses its curvature from a first state to a second state at a first predetermined temperature with a snap action and returns its curvature from the second state to the first state at a second predetermined temperature with the snap action. The reversing and returning movement of the thermally responsive element is transmitted to the movable contact member 104B through the support 106 and the pressure strip 107, thereby opening and closing the switching element 108.

In the above-described construction, the elastic support 106 applies a predetermined contact pressure between contact faces of the thermally responsive element 105 and the inner bottom face of the housing 101. Consequently, the thermal transmission between these contact faces is stabilized and accordingly, a stable thermal responsiveness can be maintained against changes in the ambient temperature.

In the above-described construction, however, the portions of the pins 103A, 103B where the respective fixed and movable contact members 104A, 104B are welded are on the sides opposed to those facing each other, as shown in FIG. 6. Consequently, one of a pair of welding electrodes is placed between the terminal pins 103A, 103B. Since a space between the pins 103A, 103B is excessively narrow in a miniature thermally responsive switch, the above-described construction results in the following disadvantages: a high pressure is applied to the welding electrodes so that a predetermined clamping pressure is maintained between a member to be welded and each terminal pin. However, since the space between the terminal pins is excessively narrow, it is difficult to form the welding electrode having a sufficient strength to withstand the clamping pressure for the welding or it is difficult to dispose the welding electrode between the terminal pins so that it withstands the clamping pressure. As a result, the clamping pressure is rendered unstable and accordingly, variations in the welding strength are increased. Furthermore, the service life of the welding electrode is shortened from the point of view of its strength, which results in its frequent maintenance and replacement. Moreover, since the range of the selecting arrangement of the welding electrode inserted between the terminal pins is restricted, an application of automatic welding is difficult and accordingly, the above-described construction lacks in the mass productivity. Furthermore, the reduction in the space between the terminal pins 103A, 103B is prevented by the arrangement of the welding electrode between them, which prevents further miniaturization of the thermally responsive switch.

Furthermore, when reversing or returning its curvature so as to be upwardly convex, the thermally responsive element 105 collides with the central portion of the support 106 such that the same is held between the pressure strip 107 and the thermally responsive element 105. As the result of a repeated impulsive load due to the collision, the central portion of the support 106 is gradually spread, which changes its spring characteristics. Consequently, since the elasticity applied to the thermally responsive element 105 by the support 106 is changed, the characteristics of the switching operation of the thermally responsive switch is changed accordingly.

The conventional thermally responsive switch further has a disadvantage that the members coupled to the terminal pins cannot be distinguished as the thermally responsive switch is seen from the outside after the necessary parts are incorporated in the housing. This disadvantage occurs, for example, when the polarity needs to be specified by using different materials for the contact portions between the movable and fixed contact members for the application of the thermally responsive switch to the control of a direct current. In this case, the internal arrangement coupled to the terminal pins cannot be distinguished in the conventional thermally responsive switch after completion of assembly of the housing as it is seen from the outside. A mark needs to be put on the header plate to specify a concave portion or the like, for example. However, when the mark is mistaken during the assembly of the parts into the housing, there is a possibility that the internal arrangement distinguished outside the housing differs from an intended internal arrangement.

SUMMARY OF THE INVENTION

Therefore, a first object of the present invention is to provide a thermally responsive switch wherein the welding of the contact members to the terminals can be performed readily, the work for the maintenance of the welding electrode can be reduced, and the miniaturization of the thermally responsive switch can be facilitated.

Another object of the invention is to provide a thermally responsive switch wherein the support supporting the thermally responsive element can be prevented from being spread at an early stage of its use so that a stable switching operation can be provided for a long period of time.

The present invention provides a thermally responsive switch comprising a generally cylindrical metal housing having an opening at one of two ends and a bottom wall at the other end. A header plate is secured to the housing so as to close the opening of the housing. The header plate has two apertures formed therethrough. First and second electrically conductive terminals are hermetically secured in the respective apertures of the header plate so as to extend into the housing. A thermally responsive element is disposed on an inner bottom of the housing so that one of two sides of the thermally responsive element is in contact with the inner bottom face of the housing. The thermally responsive element is formed from a thermally deformable material into the shape of a generally shallow dish so that the thermally responsive element reverses its curvature from a first state to a second state at a first predetermined temperature with a snap action and returns its curvature from the second state to the first state at a second predetermined temperature with the snap action. A support is disposed in the housing to be opposite to the other side of the thermally responsive element for supporting the same. The support has elasticity. A pair of fixed and movable contact members are welded to the first and second terminals respectively for cooperatively making and breaking a circuit such that a straight line passing through the center of the first terminal and a location of the fixed contact member welded to the first terminal is approximately parallel to a straight line passing through the center of the second terminal and a location of the movable contact member welded to the second terminal and vice versa and further such that the location of the fixed contact member welded to the first terminal is not substantially opposed to the location of the movable contact member welded to the second terminal and vice versa. A pressure strip is disposed between the support and the movable contact member for transmitting movement of the support due to reversion of the thermally responsive element to the movable contact member.

In accordance with the above-described construction, the fixed and movable contact members cooperatively making and breaking a circuit are welded to the first and second terminals respectively such that a straight line passing through the center of the first terminal and a location of the fixed contact member welded to the first terminal is approximately parallel to a straight line passing through the center of the second terminal and a location of the movable contact member welded to the second terminal and vice versa and further such that the location of the fixed contact member welded to the first terminal is not substantially opposed to the location of the movable contact member welded to the second terminal and vice versa. Accordingly, the welding electrode need not be disposed in the space between the terminal pins with difficulty. Consequently, the welding work can be performed readily. Furthermore, the welding electrode can be disposed to take a position where it is not easily deformed by the welding electrode pressure. Consequently, the work for maintenance of the welding electrode can be reduced.

The support may have an opening and the pressure strip may have a protrusion formed in its one end and loosely fitted in the opening of the support. It is desirable that the protrusion has a length larger than the thickness of the support. In this construction, it is the distal end of the protrusion of the pressure strip but not the support with which the thermally responsive element collides with the shock at the time of its reversing and returning operation with the snap action. Accordingly, the support can be prevented from being spread as the result of the collision with the thermally responsive element and the other kind of deformation. Consequently, the spring characteristic of the support can be maintained without any change for a long period of time.

It is preferable that the first and second terminals have one and the same length and either of the first and second terminals has a larger amount of protrusion into the housing than the other terminal. In this construction, the connection of the terminal pins to the respective contact members can be distinguished from the difference in the length of the portions of the respective terminals projected outwards from the header plate. Consequently, errors in the electrical connection with respect to the polarity can be prevented.

Other objects of the present invention will become obvious upon understanding of the illustrative embodiment about to be described. Various advantages not referred to herein will occur to those skilled in the art upon employment of the invention in practice.

BRIEF DESCRIPTION OF THE DRAWINGS

An embodiment of the present invention will be described with reference to the accompanying drawings in which.

DESCRIPTION OF THE PREFERRED EMBODIMENT

Figure 1:
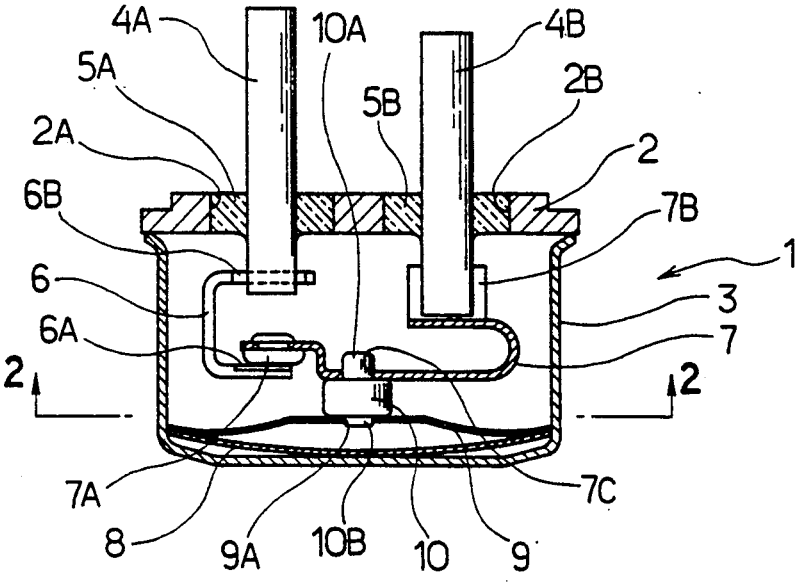
FIG. 1 is a longitudinally sectional view of a thermally responsive switch in accordance with an embodiment of the present invention.
Figure 2:
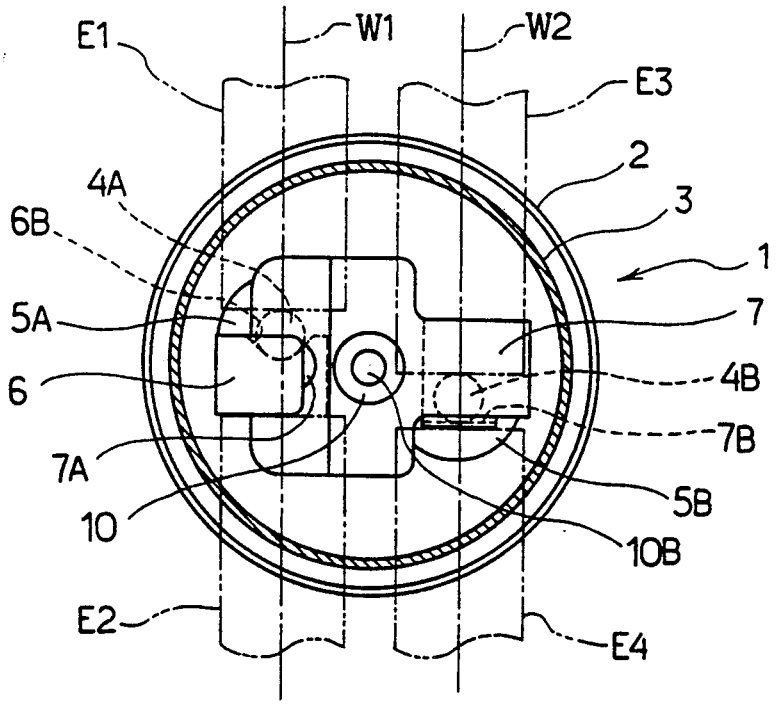
FIG. 2 is a sectional view taken along line 2—2 in FIG. 1.
Figure 5:
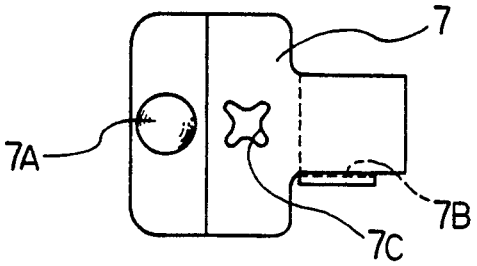
FIG. 5 is a bottom view of a movable contact member employed in the thermally responsive switch.
Figure 6:
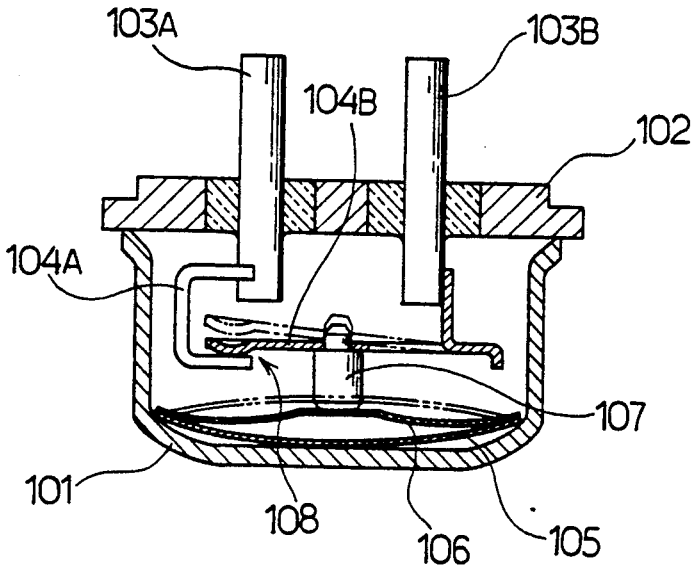
FIG.6 (PRIOR ART)
FIG. 6 is a longitudinally sectional view of a conventional thermally responsive switch.

An embodiment of the invention will be described with reference to the accompanying drawings. Referring to FIGS. 1 and 2, a thermally responsive switch 1 comprises a disc-shaped metal header plate 2 and a generally cylindrical housing 3 with an open end and a bottomed end. The header plate 2 is hermetically secured to a peripheral edge of the open end of the housing 3 by way of welding or the like such that the thermally responsive switch 1 is formed into a hermetically sealed receptacle. The header plate 2 is formed into a circular shape by stamping it from a steel plate having a thickness larger than the housing 3. The header plate 2 has two apertures 2A and 2B formed through it. Electrically conductive terminal pins 4A and 4B are inserted through the apertures 2A, 2B and hermetically secured in them by electrically insulative fillers 5A and 5B such as glass respectively. Each of the terminal pins 4A, 4B is formed from an iron-nickel alloy. A generally C-shaped electrically conductive fixed contact member 6 is formed from a thick phosphor bronze plate or the like. The fixed contact member 6 has at an upper end a weld portion 6B secured by welding to the vicinity of the lower end of the terminal pin 4A, as viewed in FIG. 1. The fixed contact member 6 has a contact material such as silver or a silver alloy fixed on the upper side of the opposite end of the fixed contact member 6, as viewed in FIG. 1. The contact material serves as a contact portion 6A engaged with and disengaged from a movable contact 7A which will be described later. A movable contact member 7 is formed from an electrically conductive, elastic material such as phosphor bronze or beryllium copper. The movable contact member 7 has at one end a weld portion 7B secured by welding to the vicinity of the lower end of the terminal pin 4B. The movable contact member 7 carries at the other distal end the movable contact 7A secured thereto by way of caulking or the like so that it is engaged with and disengaged from the contact portion 6A of the fixed contact member 6. The movable contact member 7 has an insertion aperture 7C into which a pressure strip 10 which will be described later is inserted to be fixed in position, as shown in FIG. 5. Although the contact material is welded to each of the fixed and movable contact members in the embodiment, an electrical silver plating may be applied to the contact portions of the fixed and movable contact members, instead when the thermally responsive switch is used to protect a circuit in which a relatively small current flows.

Figure 3:
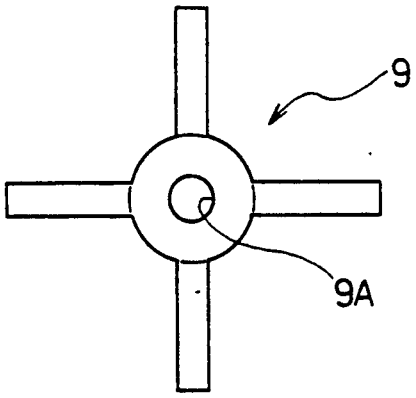
FIG. 3 is a plan view of a support incorporated in the thermally responsive switch.
Figure 4:
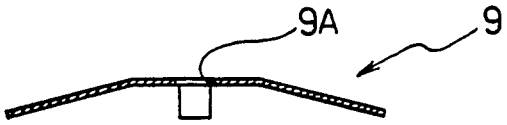
FIG. 4 is a longitudinally sectional view of the support.

A thermally responsive element 8 is disposed on the inner bottom of the housing 3 so that one of its two sides is in contact with the inner bottom face of the housing 3. The thermally responsive element 8 is formed into the shape of a generally shallow dish by stamping it from a material such as a bimetal. A support 9 having a configuration as shown in FIG. 3 is disposed on the thermally responsive element 8 in a face-to-face relation with it. The support 9 is formed from an elastic material such as beryllium copper or stainless. The support 9 has an aperture 9A formed in its central portion so as to correspond to a second protrusion 10B of the pressure strip 10, as will be described later.

The pressure strip 10 is provided on the movable contact member 7. The pressure strip 10 is formed from a heat-resisting insulative material such as a ceramic. The pressure strip 10 has a first protrusion 10A formed on its upper end, as viewed in FIG. 1. The first protrusion 10A is inserted in the insertion aperture 7C of the movable contact member 7 to be fixed in position. The pressure strip 10 also has a second protrusion 10B formed on its lower end, as viewed in FIG. 1. The second protrusion 10B is positioned in the aperture 9A of the support 9.

The operation of the thermally responsive switch 1 will now be described. The thermally responsive element 8 is downwardly convex under the condition of a normal temperature, as shown in FIG. 1. This curvature of the thermally responsive element 8 is referred to as a first state. In this condition, an elastic force is applied to the thermally responsive element 8 by the support 9 such that the thermally responsive element 8 is in contact with the inner bottom face of the housing 3 with a predetermined force. When the ambient temperature increases to a predetermined value, the thermally responsive element 8 reverses its curvature with a snap action such that the central portion of the thermally responsive element 8 is upwardly convex. This curvature is referred to as a second state. In the second state, the central portion of the thermally responsive element 8 engages the second protrusion 10B of the pressure strip 10 to push it upwards. The pressure strip 10 then pushes the movable contact member 7 such that the movable contact 7A is separated from the contact portion 6A of the fixed contact member 6, whereby the electric circuit is broken.

In the above-described thermally responsive switch, as shown in FIG. 2, the weld portions 6B, 7B of the fixed and movable contact members 6, 7 are welded to the first and second terminal pins 4A, 4B respectively such that an imaginary straight line W1 passing through the center of the first terminal pin 4A and a location of the fixed contact member 6 welded to the first terminal pin 4A is approximately parallel to an imaginary straight line W2 passing through the center of the second terminal pin 4B and a location of the movable contact member 7 welded to the second terminal pin 4B and vice versa and further such that the location of the fixed contact member 6 welded to the first terminal pin 4A is not substantially opposed to the location of the movable contact member 7 welded to the second terminal pin 4B and vice versa. As the result of these locations of weld portions 6B, 7B, electrodes E1 through E4 each serving as a welding jig can be arranged on imaginary parallel extended lines W1 and W2 connecting between the centers of the terminal pins 4A, 4B and weld points of the terminal pins respectively. In this arrangement, the welding electrodes E1–E4 can be positioned at the working position without being interrupted by each other's terminal pin. Consequently, the welding work can be automatized with ease. Furthermore, each of the welding electrodes E1–E4 serving as the welding jigs receives the contact pressure for the welding lengthwise or in the direction in which the strength of each electrode is high. Consequently, each electrode is hard to suffer deformation and the service life of each electrode can be improved with the result that the maintenance can be reduced. Additionally, the space between the terminal pins can be reduced since the welding electrodes are not inserted into the space between the terminal pins, which facilitates further miniaturization of the thermally responsive switch.

The second protrusion 10B is formed on the side of the pressure strip 10 brought into contact with the support 9. The height of this second protrusion 10B is determined so as to be as large as or larger than the thickness of the portion of the aperture 9A of the support 9. Accordingly, the distal end of the second protrusion 10B is coplanar with the underside of the portion in the vicinity of the aperture 9A or is projected downwards from that underside. As the result of this construction, the thermally responsive element 8 directly collides with the second protrusion 10B of the pressure strip 10 but not with the support 9 when the thermally responsive element reverses its curvature with the snap action. Consequently, the support 9 can be prevented from being struck by the thermally responsive element 8 with a large mechanical shock and accordingly, from being spread. Thus, the predetermined elasticity of the support 9 can be maintained for a long period of time. As a result, the thermally responsive switch of the invention can provide a stable protecting operation or durability for a long period of time.

As understood from FIG. 1, the generally C-shaped fixed contact member 6 is employed in the thermally responsive switch of the present invention. The movable contact 7A or the movable contact member 7 is positioned between the upper end of the fixed contact member 6 and the contact portion 6A at its lower end. In this structure, in order that the distance between the upper and lower ends of the fixed contact member 6 is increased as long as possible, the contact portion 6B at the upper end side is secured to the lower end side of the terminal pin 4A by way of the butt welding. Furthermore, the amount of insertion of the terminal pin 4A into the housing 3 is restricted to its minimum while that of the terminal pin 4B is determined so as to be larger than that of the terminal pin 4A. The movable contact member 7 is formed of a relatively thin material since it needs to have elasticity. In consideration of the strength of the movable contact member 7, it is practically impossible to secure the movable contact member 7 to the side of the terminal pin 4B by way of the butt welding. Accordingly, a flat face of the movable contact member 7 is welded to the terminal pin 4B as obvious from FIG. 1. Thus, since the weld portion of the terminal pin 4B is increased, the amount of insertion of the terminal pin 4B into the housing 3 is increased in comparison with that of the terminal pin 4A. In this regard, the manufacturing cost of the thermally responsive element is increased if two kinds of terminal pins with different length from each other are prepared in accordance with the amounts of insertion of the respective terminal pins into the housing 3 when the terminal pins 4A, 4B are secured in the respective apertures of the header plate 2.

In order to overcome the above-described disadvantage, the present invention employs the terminal pins 4A, 4B each having one and the same length and provides the arrangement that the terminal pins 4A, 4B are secured in the respective apertures of the header plate 2 such that the difference in the amount of insertion into the housing 3 can be secured. Thus, the dimension of the portion of the terminal pin 4A projecting outwards from the header plate 2 is larger than that of the terminal pin 4B, as shown in FIG. 1. Consequently, the correspondence between the terminal pins and the fixed and movable contact members can be distinguished. When the thermally responsive switch is connected to a direct current circuit, materials of the contact portions different from each other are employed for the fixed and movable contact members, for example. In this case, the polarity needs to be specified in the welding of lead wires after completion of the housing and in the assembly of the parts into the housing, the above-described arrangement can provide a reliable distinction of the polarity. Furthermore, the above-described arrangement can prevent the increase in the number of kinds of parts, resulting in reduction in the manufacturing cost and improvement in the productivity.

The insertion aperture in which the first protrusion of the pressure strip is press fitted is conventionally square. This conventional square aperture requires a dimensional accuracy less strict than a circular aperture. Nevertheless, the square aperture requires a relatively high dimensional accuracy since a stress is likely to concentrate on corners of the aperture. In the present invention, the insertion aperture 7C of the movable contact member 7 is formed by gouging each of the four corners of the square aperture into a round configuration. Consequently, the aperture 7C has a corrugated peripheral edge. The insertion aperture 7C is thus provided with a spring portion holding the protrusion 10A press fitted in it. Accordingly, even when the dimensional accuracy of the aperture is reduced more or less, the concentration of stress to the peripheral portion of the aperture 7C can be avoided and the pressure strip 10 can be reliably held on the movable contact member 7 by the spring portion of the insertion aperture 7C.

The foregoing disclosure and drawings are merely illustrative of the principles of the present invention and are not to be interpreted in a limiting sense. The only limitation is to be determined from the scope of the appended claims.

We claim:

1. A thermally responsive switch comprising:

a) a generally cylindrical metal housing having an opening at one of two ends and a bottom wall at the other end;

b) a header plate secured to the housing so as to close the opening of the housing, the header plate having two apertures formed therethrough;

c) first and second electrically conductive terminals hermetically secured in the respective apertures of the header plate so as to extend into the housing;

d) a thermally responsive element disposed on an inner bottom of the housing so that one of two sides of the thermally responsive element is in contact with the inner bottom face of the housing, the thermally responsive element being formed from a thermally deformable material into the shape of a generally shallow dish so that the thermally responsive element reverses its curvature from a first state to a second state at a first predetermined temperature with a snap action and returns its curvature from the second state to the first state at a second predetermined temperature with the snap action;

e) a support disposed in the housing to be opposite to the other side of the thermally responsive element for supporting the same, the support having elasticity;

f) a pair of fixed and movable contact members welded to the first and second terminals respectively for cooperatively making and breaking a circuit such that a straight line passing through the center of the first terminal and a location of the fixed contact member welded to the first terminal is approximately parallel to a straight line passing through the center of the second terminal and a location of the movable contact member welded to the second terminal and vice versa and further such that the location of the fixed contact member welded to the first terminal is not substantially opposed to the location of the movable contact member welded to the second terminal and vice versa; and g) a pressure strip disposed between the support and the movable contact member for transmitting movement of the support due to reversion of the thermally responsive element to the movable contact member.

2. A thermally responsive switch according to claim 1, wherein the first and second terminals have one and the same length and either of the first and second terminals has a larger amount of insertion into the housing than the other terminal.

3. A thermally responsive switch according to claim 1, wherein the movable contact member has an opening with a continuous corrugated peripheral edge and the pressure strip has at an end a protrusion press fitted into the opening of the movable contact member.

4. A thermally responsive switch comprising:

a) a generally cylindrical metal housing having an opening at one of two ends and a bottom wall at the other end;

b) a header plate secured to the housing so as to close the opening of the housing, the header plate having two apertures formed therethrough;

c) first and second electrically conductive terminals hermetically secured in the respective apertures of the header plate so as to extend into the housing;

d) a thermally responsive element disposed on an inner bottom of the housing so that one of two sides of the thermally responsive element is in contact with the inner bottom face of the housing, the thermally responsive element being formed from a thermally deformable material into the shape of a generally shallow dish so that the thermally responsive element reversing its curvature from a first state to a second state at a first predetermined temperature with a snap action and restoring its curvature from the second state to the first state at a second predetermined temperature with the snap action;

e) a support disposed int he housing to be opposite to the other side of the thermally responsive element for supporting the same, the support having elasticity and an opening at a preselected portion thereof;

f) a pair of fixed and movable contact members welded to the first and second terminals respectively for cooperatively making and breaking a circuit; and g) a pressure strip disposed between the support and the movable contact member and having one of two ends coupled to the movable contact member and the other end loosely fitted in the opening of the support for transmitting movement of the support due to reversion of the thermally responsive element to the movable contact member.

* * * * *